US005264035A

United States Patent [19]

Beisswanger et al.

[11] Patent Number: 5,264,035

[45] Date of Patent: Nov. 23, 1993

[54] DOCTOR HOLDER FOR A COATING DEVICE

[75] Inventors: Rudolf Beisswanger, Steinheim; Zygmunt Madrzak, Heidenheim, both of Fed. Rep. of Germany

[73] Assignee: J.M. Voith GmbH, Fed. Rep. of Germany

[21] Appl. No.: 717,974

[22] Filed: Jun. 20, 1991

[30] Foreign Application Priority Data

Jul. 11, 1990 [DE] Fed. Rep. of Germany ..... 4022097

[51] Int. Cl.[5] ..... B05C 11/04

[52] U.S. Cl. ..... 118/126; 118/261; 118/413; 15/256.53

[58] Field of Search ..... 118/126, 261, 413; 15/256.51, 256.53; 100/174; 101/162, 425; 162/281; 355/299

[56] References Cited

U.S. PATENT DOCUMENTS

| | | | |
|---|---|---|---|
| 2,466,734 | 4/1949 | Piazze | 15/256.51 |
| 3,085,275 | 4/1963 | Allison | 15/256.51 |
| 3,781,107 | 12/1973 | Ruhland | 15/256.53 |
| 4,165,965 | 8/1979 | Bernardelli et al. | 15/256.51 |
| 4,877,122 | 10/1989 | Morin | 15/256.51 |
| 4,961,406 | 9/1989 | Goodrow et al. | 100/174 |
| 5,007,132 | 4/1991 | Reid | 100/174 |
| 5,066,364 | 11/1991 | Goodrow et al. | 162/281 |
| 5,138,740 | 8/1992 | Goodrow et al. | 15/256.51 |

FOREIGN PATENT DOCUMENTS

| | | | |
|---|---|---|---|
| 2474899 | 8/1981 | France | 15/256.53 |

OTHER PUBLICATIONS

Kneiser, "Cleaning Blade Belt", Xerox Disclosure Bulletin, vol. 1, Nos. 9/10, Sep./Oct. 1976, p. 71.

*Primary Examiner*—W. Gary Jones
*Assistant Examiner*—Todd J. Burns
*Attorney, Agent, or Firm*—Ostrolenk, Faber, Gerb & Soffen

[57] ABSTRACT

A doctor holder for a surface coating device or a web coating device has a guide body with a guide path channel through it. A leaf spring like doctor strip is advanced along the length of the channel and across the width of the web being coated. The doctor strip has a row of cutouts in it for enabling it to be advanced through the guide body. One of various forms of guide elements advance the doctor strip. The guide elements may be projections from an endless chain, or may be teeth of a sprocket wheel, or may be individual separate guide elements like balls and the guide elements extend into the cutouts and then into a guide groove in the guide body. The doctor strip is wound onto a reel after leaving the guide body. The guide element balls, or the like, are installed at the beginning of the guide path and are removed e.g. by an air blast, at the end of that path.

26 Claims, 3 Drawing Sheets

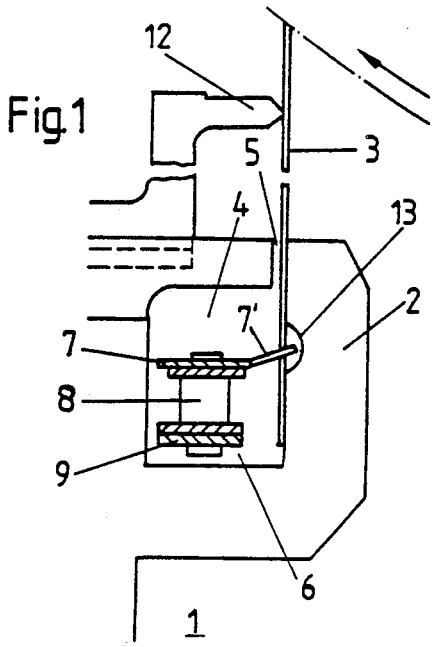
Fig.1
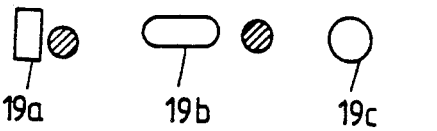
Fig.7a Fig.7b Fig.7c
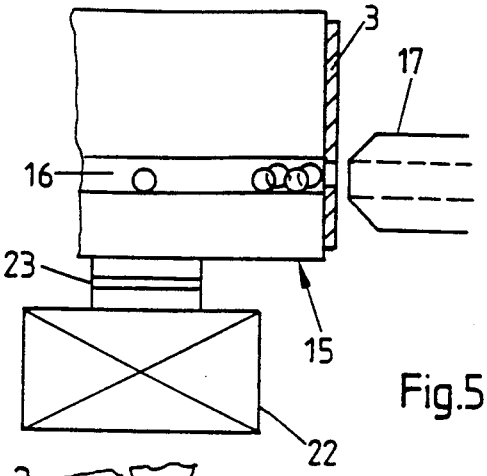
Fig.5
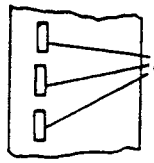
Fig. 6a
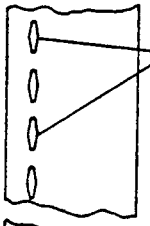
Fig.6b
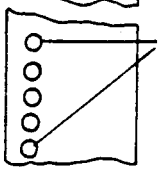
Fig.6c
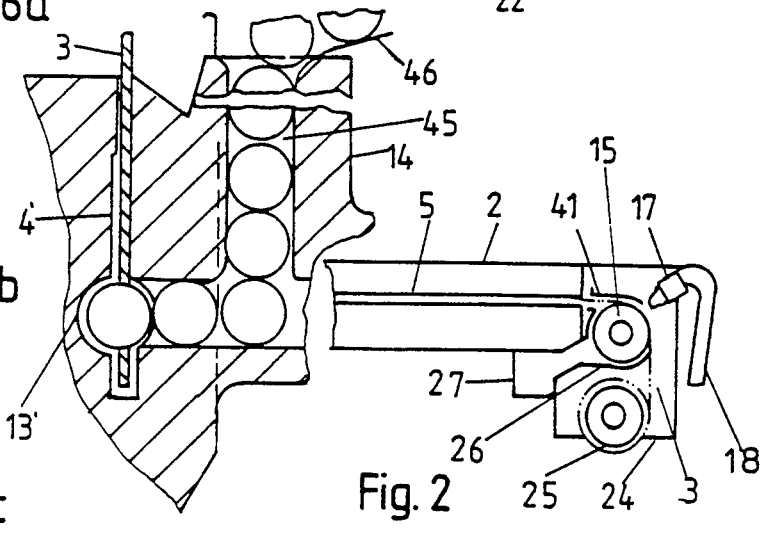
Fig. 2
Fig. 8
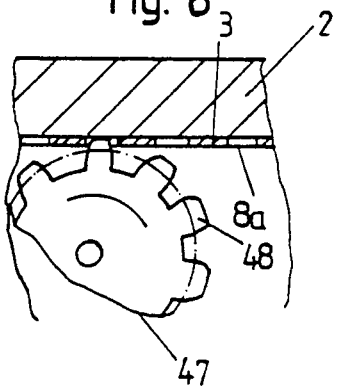
Fig.3
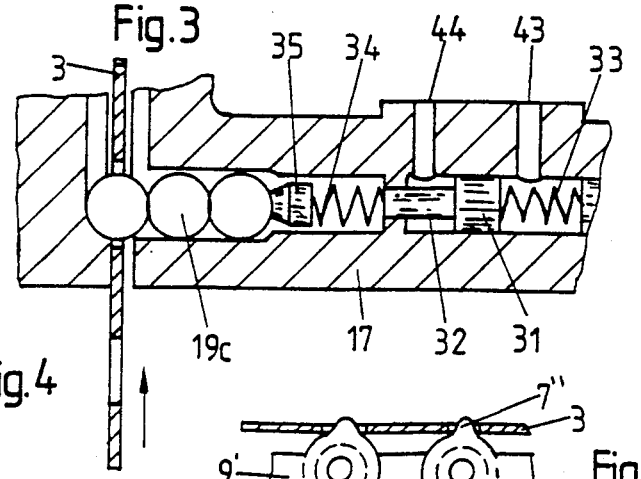
Fig.4
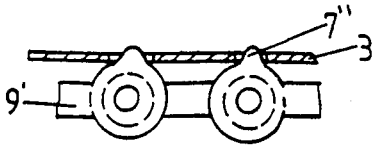
Fig.10

DOCTOR HOLDER FOR A COATING DEVICE

BACKGROUND OF THE INVENTION

The present invention relates to a doctor holder for a coating device used in coating a surface, like a web, in a paper making machine.

In a doctor holder disclosed in German Unexamined Published Application for Patent OS 28 22 682, there are projections by which the doctor strip is held in a groove in the doctor guide. These projections are provided on the doctor strip in the region of the edge of the strip that is remote from its scraping edge. In this way, the web of material can pull the doctor strip only in a given position. The doctor strip remains in that position during operation. In one embodiment, these projections can also be rivets with the customary round head. On the other hand, hook shaped flanges, which may also be provided at places which are partially punched out, are used as holding elements. By this development of the doctor strip, however, winding up of the doctor strip in a suitable manner is possible only with great difficulty, if at all. Furthermore, manufacture of the doctor strip with, for instance, rivet heads is very expensive and cumbersome.

SUMMARY OF THE INVENTION

The object of the invention is to provide a doctor holder for a doctor strip which permits easy manufacture and easy winding up of the doctor strip and which also permits advancing of the doctor strip in a simple and wear free manner.

The present invention concerns a doctor holder for a doctor strip that is used for doctoring coating material on a surface, such as a moving web or a moving web moving over a roller. The doctor strip has an edge that doctors the coating material. The doctor strip is supported in a guide body to extend across the surface or web being coated, and means are provided for moving the doctor strip along the guide body and across the surface. The doctor strip has cutouts defined in it and extending along its length.

Guide elements supported in the guide body engage in the cutouts of the doctor strip for guiding the motion of the doctor strip across the guide body. The guide elements may take various forms. In one form, the guide elements are supported on an endless conveyor strip, which may be in the form of a chain, for example, and the guide elements extend from the conveyor strip into the cutouts in the doctor strip. The cutouts may be arranged in a row and the guide elements would then be in a row along the same path. Other arrangements for the cutouts and therefore for the guide elements may be envisioned.

In another form, the guide elements are comprised of unconnected individual elements, such as balls, cylinders, etc. The guide elements would be comprised of an appropriate wear resistant, good sliding material, such as polytetrafluoroethylene. Guide means in the guide body, such as a groove therein, define a path for the guide elements. The guide elements extend through the cutouts and into the guide means or groove in the guide body which guides the doctor strip through the guide body. In that case, means are provided for installing the guide elements in the doctor strip at the beginning of its path in the guide body and for removing the guide elements from the cutouts of the doctor strip at the end of the path of the doctor strip in the guide body. Compressed air may be used for removing the guide elements from the guide body or a controlled timed ram or other means may be used.

Where the means for removing the guide elements from the cutouts comprises a ram or other mechanical means, appropriate timing means are provided for operating the ram or guide element removing means. For example, there may be a roller communicating with the doctor strip having cams arranged on it to control the operation of the guide element removing means and coordinate it with the movement of the doctor strip.

Where there are individual unconnected guide elements, there may be a guide cylinder at the end of the guide path around which the doctor strip partially wraps. That guide cylinder could have a circumferential groove placed to receive the individual guide elements as they are removed from the doctor strip.

Means for recycling the individual guide elements for reinstallation in the doctor strip may be provided. That means would include a guide path for bringing the guide elements, after their removal from the exit side of the doctor strip, around to the entrance side of the doctor strip where they are reinstalled.

Other objects and features of the invention are explained below with reference to the embodiment shown in the drawings.

BRIEF DESCRIPTION OF THE DRAWINGS

FIG. 1 is a side view of the doctor holder including one embodiment of the invention;

FIG. 2 is a top view thereof;

FIG. 3 is a side cross-section of a second embodiment of a doctor holder of the invention;

FIG. 4 is a longitudinal section through a third embodiment of a doctor holder including the invention;

FIG. 5 shows a fragmentary detail of the winding device in the region of the guide roller for the doctor strip;

FIG. 6*a*, 6*b*, 6*c* are views of different embodiments of a doctor strip showing different perforation arrangements of the doctor strip;

FIGS. 7*a*, 7*b*, 7*c* show different embodiments of guide elements usable for the doctor strips in FIGS. 6*a*, 6*b*, and 6*c*, respectively, with FIGS. 7*a* and 7*b* showing both side and cross sectional views;

FIG. 8 is a fragmentary side cross section showing a fourth embodiment of a doctor holder of the invention;

FIG. 10 shows a chain embodiment of doctor strip advancing means with guide elements;

DESCRIPTION OF THE PREFERRED EMBODIMENTS

Figure 9:
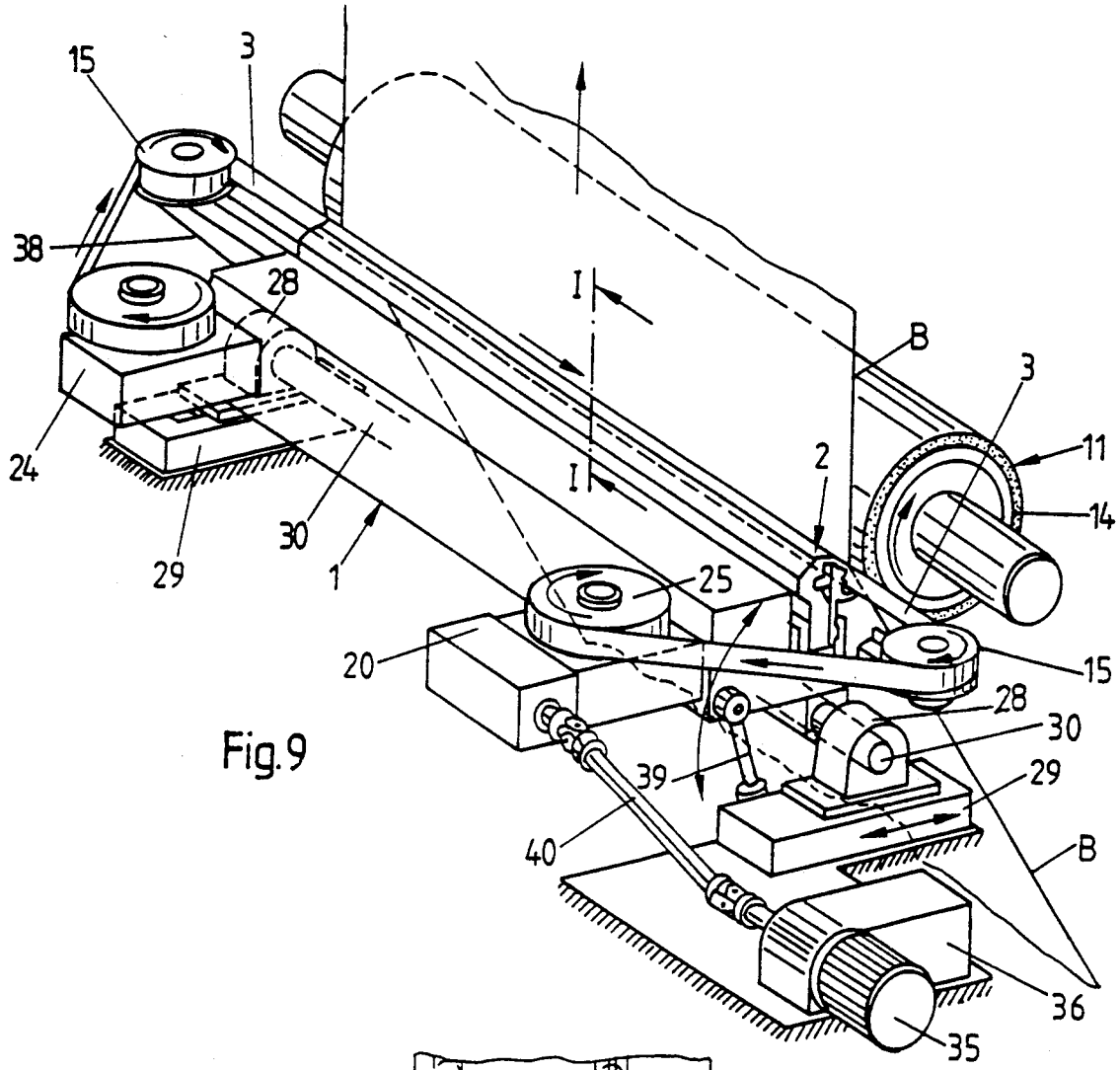
FIG. 9 is a perspective view of the overall arrangement including an embodiment of the doctor holder.

Referring to FIGS. 1 and 2, a doctor strip 3 is a thin flat strip which has the qualities of a leaf spring. It is flexible enough to be wound onto a roll after the strip has been advanced through a doctor holder. Yet, it is stiff enough to doctor a layer of coating material on a web or a roll, across the full width of the coating device. The strip 3 travels within a channel 4 of a guide body 2, which is formed in a doctor strip holding carrier 1.

The doctor strip 3 is generally pressed by a pressure element 12, which is comprised of several parts that extend along the cross machine length. The upper or working edge of doctor strip 3, (as seen in FIG. 1), is pressed against the web of material, shown in dash-dot line, or the mating roll (not shown) that guides the web.

The guide body 2 has a narrow slit 5 through which the doctor strip extends out of the channel 4 and toward the web. The slit 5 is preferably about 0.0 to 0.3 mm wider than the thickness of the doctor strip.

The doctor strip moves in the cross machine direction through the channel 4. As shown in FIG. 2, the doctor strip 3 is deflected at the end of the guide body 2 around a guide roller 15 and is wound up on a drum 25 which is provided on a projection 24 of the doctor carrier.

As shown in FIG. 1, an endless link type conveyor chain 8 travels within the channel 4. The chain has two runs or courses, one inside the channel 4 and another outside it (not shown). One link of the one run of the chain is seen in FIG. 1. On its bottom side the link chain is formed with link plates 9. On its top side, in place of connecting plates 9, chain 8 has doctor strip advancing and guide elements 7, each having a gripping end 7' for gripping the doctor strip 3 by engaging in cutouts in the strip. The cutouts are in the form of one of the cutouts 8*a*, 8*b* or 8*c* in FIGS. 6*a*, 6*b* or 6*c*, respectively. The gripping end 7' is for this purpose inclined between 90° and 45° with respect to the facing side surface of the strip. A clearance groove 13 in the guide body 2 permits free forward displacement of the guide elements 7, 7'.

The pull exerted by the web of material advancing in the direction of the arrow in FIG. 1 moves the doctor strip 3 forward, or up in FIG. 1, such that the lower edge of its cutouts 8*a*, 8*b*, or 8*c* rests against the gripping end 7' of the guide element 7. This exactly positions the doctor strip against the web during operation, since on the other side, the guide body 2 determines the lateral position of the doctor strip 3. It would also be possible to use a chain provided with chain links 8 developed with correspondingly large diameter and to use either the chain links themselves or lateral projections of or teeth of a toothed chain as the guide elements.

FIGS. 3 and 4 show an embodiment in which the chain is omitted, and individual separated ball shaped guide elements 19*c* are instead provided. These balls can, for instance, be comprised of plastic of high resistance to wear and low coefficient of friction, for example polytetrafluoroethylene marketed under the trademark Teflon.

Starting from the top of the guide body 14, the balls are fed down along a filling chute 45 and are pushed into the cutouts 8*c* (FIG. 6*c*), for instance, of the doctor strip 3, which are preferably arranged every 10 to 15 cm apart. The balls are pushed by a pushing device which comprises a hydraulically actuated piston 31 with a piston rod 32, springs 33 and 34, and pressure piece 35. For this purpose, sufficient cutouts 8*c* are provided in the doctor strip 3, in the same way, for instance, as the perforations of a photographic film (see FIG. 6). For this purpose, the spring 33 has a relatively high spring constant and the spring 34 has a relatively low spring constant. Hydraulic pressure fluid is fed through the channels 43 and 44 to move the piston 31 and the piece 35 as needed.

Returning to FIG. 2 and to FIG. 5, after leaving the guide body 2, the doctor strip 3 is deflected around a guide roller 15 mounted on a shaft 23 supported on a support 24. The roller 15 has a circumferential groove 16 around its circumference at the axial region thereof which aligns with the cutouts 8*c* in the doctor strip. Balls 19*c* blown or pressed out of the doctor strip are caught in the groove 16. The balls are preferably blown out of the doctor strip by compressed air from a compressed air nozzle 17. The air is fed to the nozzle through a hose 18. A guide plate 41 at the roller 15, upstream of the nozzle 17 in the path of the strip, prevents the balls from being blown out on the wrong side. The balls are then collected from the groove 16 by a hopper 26, which feeds them to a collecting vessel 27.

After the balls 19*c* have been cleaned, they may be used again as guide elements for the doctor strip. The balls are then introduced into a sheet metal trough 46 from which they roll to the feed hopper 45.

The drum 25 has a drive (not shown here), which is preferably in the form of an electric motor which is reversible. If such guide rollers 15 and winding rolls 25 are provided on both the doctor strip entrance and exit sides of the guide body 2 and of the doctor carrier 1, with the winding rolls each having their own drives, then the doctor strip can be moved back and forth through the guide body. The wind up doctor strip can have a great length, and a total length of about 200 meters can be obtained today from known manufacturers.

In FIG. 1, a drive can be provided for the guide element chain 6. Only one course or run of the chain travels in the channel 4 of the guide body 2. The other course of the chain travels outside the doctor holder guide body 2 and that course can be driven by a motor and by a pinion driven by the motor to drive the chain. (This drive is not shown.) This provides a constant speed of advance of the doctor strip 3.

In the event of guidance of the strip 3 by insertable guide element balls 19*c*, as shown in FIGS. 3 and 4, the balls are guided in a ball guide groove 13' which is formed in the guide body 2 and which intersects the channel or slit 4' in the guide body 2. The channel 4' of the guide body 2 is then only very narrow.

In FIGS. 7*a* and 7*b*, alternate forms of guide elements 19*a* and 19*b* are indicated. These forms of the guide elements both have a circular cross section. The elements 19*a* are simple small cylinders, while the elements 19*b* are generally cylindrical, but are rounded at their ends. The rounding enables the elements 19*b* to slide easier along a guide groove, which is adapted in FIG. 3 to the contour of the guide elements. The diameter of the balls or the circular cross section of the guide elements should be in a range between 10 and 16 mm.

The guide elements 19*a*, 19*b* or 19*c* are shaped to be insertable in respective correspondingly shaped cutouts 8*a*, 8*b* or 8*c*. The balls 19*c* can also be inserted into elongated cutouts, as shown in FIG. 6*a*, if those cooperating elements are so dimensioned that the balls are clamped slightly in the cutouts, i.e. the height of the cutouts is somewhat smaller than the diameter of the balls. If the balls are comprised of plastic, they can easily be clamped. This provides a rather precise guidance of the doctor strip 3. In this case, the balls should be replaced with new ones every week.

The guide body is somewhat wider in the cross machine direction than the maximum width in the cross machine direction of the web of paper or than the length of the counter roll which guides the web so that the chute 45 can be provided for feeding the guide elements or balls 19.

Various endless loop chains and particularly drive chains may be used, in particular a toothed chain in which the guide elements for the doctor strip are provided practically by the chain teeth. Such chains are readily obtainable from a known manufacturer. It is possible to use a strip or a rope, rather than a chain. But, the manufacture or supply of a rope with the necessary guide elements could be difficult. Nevertheless, the existing spatial possibilities are quite limited, so that relatively small dimensions for the chains or other guide elements are desirable.

FIG. 8 shows an arrangement in which the guide elements comprises gear wheels 47 with teeth 48 which engage into the cutouts 8*a* (FIG. 6*a*) in the doctor strip 3. The gear wheels may also be pinions or sprocket wheels. As in the other embodiments, in FIG. 8, the doctor strip is wound up on a drum 25 (not shown in FIG. 8), and the drum is driven by a motor. The teeth 48 guide the doctor strip in the direction of its plane, which is formed, for instance by one of its side surfaces.

In the embodiment shown in FIG. 10, the chain links 9' have respective lateral projections 7'' at one lateral side, and these projections engage into the cutouts 8*a*, 8*b* or 8*c* of the doctor strip.

In all of the embodiments shown, the guide elements press against the edge of the cutouts in the doctor strip which are remote from the scraping edge, as shown in FIG. 1.

FIG. 9 shows an overall perspective view of a device according to the invention with a rubberized counter roll 11 which serves to guide the web material B. The roll 11 has a roll core 14 of steel. This embodiment has loose guide elements, for instance the balls in FIG. 5. The nozzle, the ball guide and the collecting trough for the balls have been omitted.

The guide roller 15 is supported by extensions 38 of the doctor carrier 1 so that sufficient space is present for feeding the balls and for the collection trough.

The drive motor 35 with its gearing 36 drives, via worm gearing 20, the winding drum 25 by link rod 40. The doctor holder 1 is displaceable, as indicated by the double ended arrow W, with respect to the counter roll 11 along the slide guide 29. However, it can also be swung as indicated by the double ended arrow V with respect to the counter roll by the mounting pins 30 which are carried in bearings 28 and the swinging is done by means of a connecting rod 39. These possible displacements can, however, also be obtained by means of swing levers.

The construction of FIG. 9 may be used even if a chain is used as the guide means as in FIG. 1, and that course of the chain that is remote from the doctor strip is adapted to slide along the outside of the doctor carrier.

Figure 11:
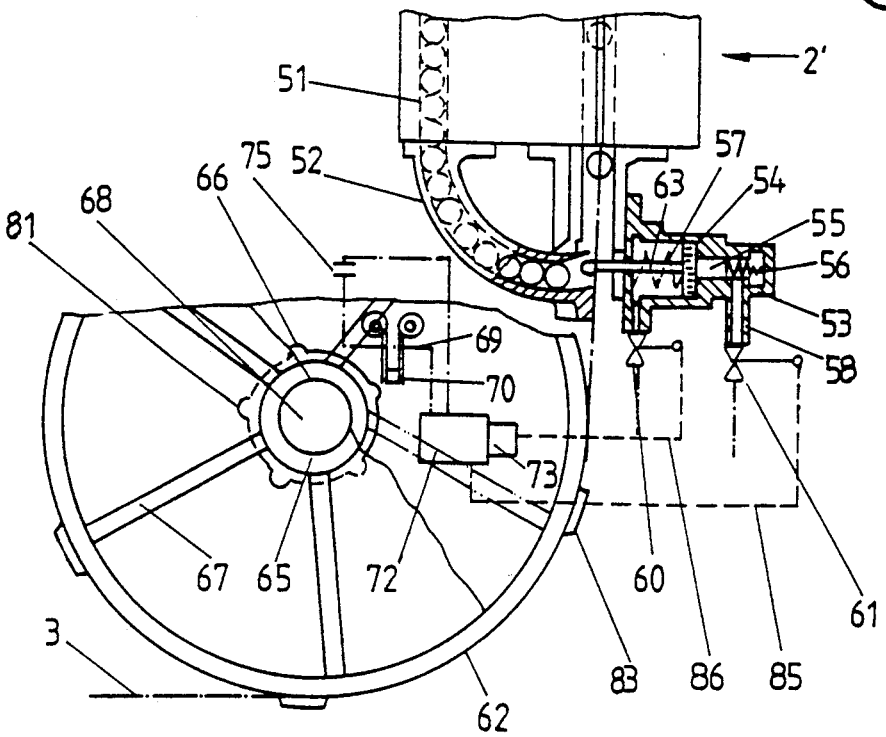
FIGS. 11 and 12 each show a respective top view of sections of fifth and sixth embodiments of a doctor holder, with a return device for loose guide elements.

FIG. 11 shows another arrangement of the invention in which the guide elements are balls which are positively guided by additional outer guide paths 52 arranged in the guide body 2' on one or both sides of the guide body. A ram 63 pushes the balls out of the doctor strip 3 after the strip has left the guide body and before the strip 3 is wound up. For this purpose, there is a reciprocating device 53 which has a smaller diameter piston 55 at one side and a piston 54 of larger diameter and two springs 56 and 57 acting on the pistons. For actuating the reciprocating element, there is a hollow drum 62 having a wall which is held by spokes 67 on a hub 65, and the hub is mounted on a shaft or axle 68. Further, the drum is provided with a central cam wheel 66 which rotates in synchronism with the drum and is coupled to the drum, for instance to the bottom of the drum or, if a drive shaft of the drum is provided, with the drive shaft 68. Furthermore, the drum preferably is provided on its circumferential periphery with projections 83 which engage into the cutouts, for instance cutouts 8*a*, of the doctor strip 3. In this way, the drum 62 travels in synchronism with the doctor strip 3. The spacing of the cams 81 on the cam wheel 63 is in accordance therewith. These cams actuate the contact 70 of a switch 69. As a result, a pulse is given to a control device 72 via a current circuit which is fed by a source of voltage 75. Via line 85, this pulse then serves to actuate the solenoid 61. The solenoid is connected to a connection 58 of the reciprocating device 53 and acts with pressure fluid on the piston 55. This actuates the ram 63 at the correct time to press each ball out of the corresponding cutout of the doctor strip. A timer 73 can be provided which, after a set period of time, for instance 8 or 10 seconds, acts with pressure fluid on the large piston 54 via line 86 to cause the ram to again be withdrawn in time before the corresponding cutout has moved too far away and so that the ram has been withdrawn into the starting position to avoid the ram or doctor strip being damaged.

The additional lateral guide path 52 is preferably open on its top and bottom (as shown) in the region of the end of the guide body 2' so that there is the possibility of cleaning the balls and the doctor strip, for instance by means of spray nozzles and cleaning liquid. The liquid can be readily collected at the bottom in a container.

This is possible for the reason that in this region the balls are still guided by the doctor strip within whose cutouts the balls are then still being held. In the arrangement shown, a new ball is pressed into a corresponding cutout of the doctor strip by the pushing out of the one ball at the other end of the guide body 2', since the balls lie close alongside each other along the guide path 51 and the path returns the balls from the end exit to the other entrance end of the guide body 2'.

The signal from the cams 66 of the cam path can also be used for triggering a trigger circuit which produces the signal of the control device 72. This trigger circuit should, for instance, contain a sensor which operates on an electromagnetic conductive basis or on the eddy principle. In this case, the balls could also be of metal, for instance of steel. The sensor precisely detects the position of the cutouts 8*a*, etc. of the doctor strip 3 and thus detects the exact position of a ball. This enables the ram 63 to be actuated precisely at the correct moment, namely when a ball is precisely centrally opposite it.

The sensor could, for instance, detect the precise position of a cutout containing no balls which arrives two, three or more cutouts earlier or later.

One could also dispense with the cam path, because each ball is arranged only in a given number of cutouts following a given jump of cutouts. The triggering and actuation of the ram at the correct time could then be effected with an absolutely constant speed of travel of the doctor strip by means of a timer.

If a counter counts the number of pulses produced per cutout without a ball, then, starting from a cutout which is detected and which shows a magnetically or electrically conductive ball, one could dispense with a timer and the speed of travel of the web of goods need then also not be constant. By means of a threshold member, the pulses given off by the sensor can be used for the triggering only when the cutout lies substantially precisely centrally opposite the sensor. This enables detection of the exact point of time for the release and actuation of the ram.

Figure 12:
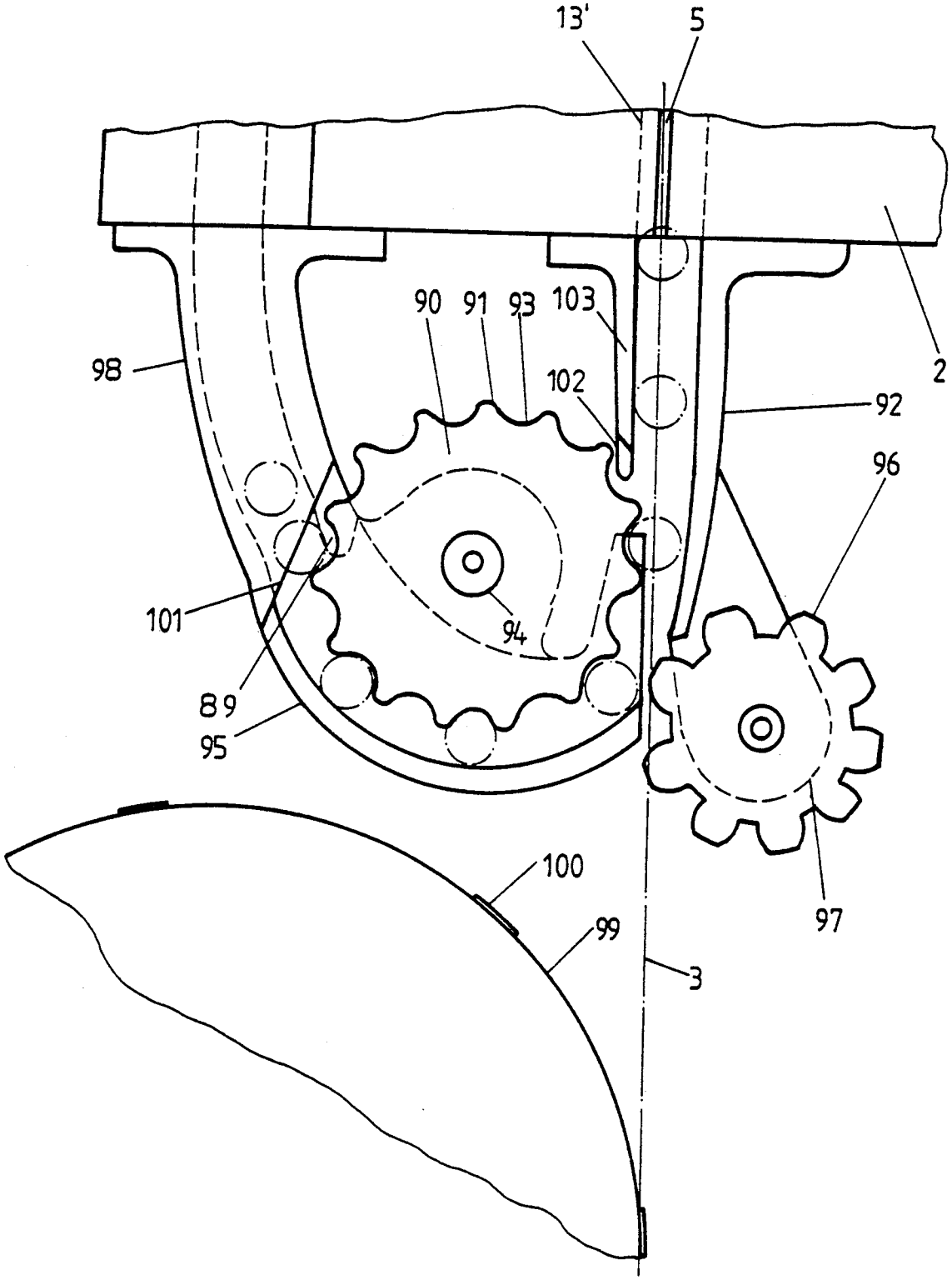

The return arrangement for the guide elements, shown as balls, of the doctor strip 3, as shown in FIG. 12, has two additional guide bodies 92 and 95, which provide a return path for the balls. Both paths could also be considered to constitute a single path comprised of two parts. In such a case, however, they are also structurally separate. A connection would be possible or meaningful essentially only on the left hand side of the doctor strip 3, as seen in the FIG. 12. In view of the separation of the guide bodies 92 and 95 by the doctor strip which passes between those bodies, it appears more meaningful to construct the two guide bodies as separate structures. The guide body 92 can preferably be open on top and on bottom in order, as noted above, to permit cleaning of the guide element balls by means of jet nozzles and possibly to also permit cleaning of the doctor strip. This would also contribute to reducing the danger of the guide elements and their paths becoming dirty.

Within the arc formed by the guide paths there is a gear wheel 90 with substantially rounded cutouts or spaces 93 between teeth 91, which serve to receive the balls from the doctor strip. In this connection, the balls are pressed out from the doctor strip from the right hand side at the additional guide body 92. On the right hand side of the doctor strip 3, there is a gear wheel 97 having teeth 96 which engage synchronously into the cutouts 8*a*, 8*b* and 8*c* of the doctor strip and press the balls completely out of the cutouts. This additional gear wheel could, however, possibly be omitted. After the balls have been pressed out of the doctor strip by the teeth 96 of the gear wheel 97, they are completely removed from the doctor strip 3 by the start of the guide path through the guide body 95 and are then carried along further by the gear wheel 90. The balls again are lifted off the gear wheel 90 by the right hand side of the closed part 98 of the guide body 95. Here the initial part of the guide body 95 is left open on top, but it could also be developed to be closed on top. The depth of the spaces 93 between the teeth 91 is so slight that the balls are received by them only up to ⅓ or at most 2/5 of their diameter so that the balls can also be lifted more easily out of the spaces. The doctor strip 3 is then led away by a drum 99 having projections 100 which engage in the cutouts of the doctor strip. The drum 99 and the gear wheels 90 and 96 are driven synchronously in rotation, for instance, the drum 99 is driven for moving the projections 100 in the doctor strip 3, and the gear wheels 90 and 96 are coupled to the drum 90 by additional gear wheels (not shown).

Instead of the gear wheel 90, a toothed strip could be provided. The gear wheels can preferably be comprised of plastic. By a step 101 in the return path of the guide body 95, a ball can be prevented from traveling back into a tooth space which is not occupied. The gear wheel 90 can be made relatively thin so that at the start of the closed part 98 of the return path, a nose shaped projection 89 can be arranged directly below the gear wheel. It presses the balls already in advance somewhat out of the tooth spaces 93 so that the teeth can convey the balls into the return path as smoothly as possible. A similar nose shaped projection can also be provided directly above the gear wheel.

In order to reduce the friction, the part of the guide body 95 and particularly its ball parts, which is shown open here, can also be made of a plastic of very low friction, such as Teflon, at least in the region of the balls. These path guide parts could then also be screwed onto a metal support which serves, for instance, also for holding the gear wheel 90 or other gear wheels.

If the arrangement shown is provided on both cross machine sides of the guide path 2, it can also serve for the refilling of the doctor strip upon the reverse direction of advance. By means of a nose 102 at the start end or end of the guide path part 103, the balls could then be prevented from unintentionally leaving their cutouts in the doctor strip.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A doctor holder for use in a surface coating device, the doctor holder comprising:

a guide body including means for supporting a doctor strip;

a doctor strip supported by the supporting means of the guide body for movement past the guide body in the direction across the width of the surface being coated and doctored by the doctor strip and means for moving the doctor strip across the width of the surface and past the guide body;

the doctor strip having an array of cutouts along its length which are arranged in the direction across the width of the surface being coated, said array of cutouts being clear of said working edge;

movable guide elements supported by the guide body and positioned for extending into the cutouts in the doctor strip for guiding the doctor strip in its movement across the guide body, the guide elements being movable into the cutouts while being supported in the guide body for guiding the doctor strip over the width of the surface and being movable out of the cutouts after the doctor strip has been guided over the width of the surface; and while said surface coating device is operating to coat the surface being coated, certain of said elements remaining entered into certain of said cutouts in said doctor strip.

2. The doctor holder of claim 1, wherein the guide elements are arranged a substantially constant distance apart from each other across the guide body.

3. The doctor holder of claim 2, wherein the doctor strip has longitudinal edges across the width of the surface, the cutouts are arranged in a row along the doctor strip and generally parallel to the longitudinal edges of the doctor strip; and the guide elements are also arranged in a row across the guide body.

4. The doctor holder of claim 1, wherein the guide elements are arranged in the guide body for being displaceable along the guide body, along the path of the doctor strip and across the width of the surface.

5. The doctor holder of claim 4, wherein the guide elements comprise the gear teeth of at least one gear wheel, and the gear teeth engage in the cutouts of the doctor strip.

6. The doctor holder of claim 4, further comprising a guide element conveyor strip on which the guide elements are provided, and the conveyor strip being movable along the guide body for conveying the guide elements along the guide body for moving the doctor strip along the guide body.

7. The doctor holder of claim 6, further comprising a groove in the guide body through which the conveyor strip passes as it engages the cutouts of the doctor strip;

cleaning means at the groove for spraying cleaning medium into the groove for the guide elements.

8. The doctor holder of claim 6, wherein the conveyor strip is an endless continous conveyor strip.

9. The doctor holder of claim 8, wherein the endless conveyor strip has one course travelling through the guide body on which the guide elements are defined.

10. The doctor holder of claim 9, wherein the guide elements are projections from the conveyor strip for extending into the cutouts.

11. The doctor holder of claim 6, wherein the guide elements are projections from conveyor strip into the cutouts.

12. The doctor holder of claim 11, wherein each projection from the conveyor strip includes a gripping end, which extends from the projection into a respective cutout in the doctor strip and with respect to the side of the doctor strip is at an angle of between 45° and 90°.

13. The doctor holder of claim 11, wherein the projections extending into the cutouts are so shaped and the cutouts are so shaped that with the doctor strip in engagement with the web moving past the doctor strip, the projections from the conveyor strip engage the cutouts on the edge of the cutouts that is removed from the edge of the doctor strip engaging the web.

14. A doctor holder for use in a surface coating device, the doctor holder comprising:

a guide body including means for supporting a doctor strip;

a doctor strip supported by the supporting means of the guide body for movement past the guide body in the direction across the width of the surface being coated and doctored by the doctor strip and means for moving the doctor strip across the width of the surface and past the guide body;

the doctor strip having an array of cutouts along its length which are arranged in the direction across the width of the surface being coated;

movable guide elements supported by the guide body and positioned for extending into the cutouts in the doctor strip for guiding the doctor strip in its movement across the guide body, the guide elements being movable into the cutouts while being supported in the guide body for guiding the doctor strip over the width of the surface and being movable out of the cutouts after the doctor strip has been guided over the width of the surface;

said guide elements being arranged in the guide body for being displaceable along the guide body, along the path of the doctor strip and across the width of the surface;

the guide elements being individual, normally separate elements;

the guide body having a guide path along it through which the cutouts of the doctor strip pass;

means for installing an individual guide elements into each cutout, the guide elements and the guide path through the guide body being so shaped that each guide elements extending into a cutout also extends into the guide path, whereby the guide element in the cutout and in the guide path guides the doctor strip through the guide body.

15. The doctor holder of claim 14, wherein said installing means further comprises means for installing an individual guide element into the cutout at the start of the path of the doctor strip through the guide body, and means for removing the guide element from the cutout at the end of the path of the guide strip through the guide body.

16. The doctor holder of claim 15, wherein the removing means comprise means for delivering compressed air to the guide strip at the cutouts for blowing the guide elements out of the cutouts.

17. The doctor holder of claim 14, wherein the guide elements are generally ball shaped.

18. The doctor holder of claim 14, wherein the guide elements are comprised of a plastic material having good sliding properties and resistance to wear.

19. The doctor holder of claim 18, wherein the guide elements are comprised of polytetrafluoroethylene.

20. The doctor holder of claim 14, wherein the guide path for the guide elements through the guide body comprises a guide groove positioned in the guide body at a location corresponding to the path of motion of the cutouts through the guide body, whereby the guide elements may extend into the cutouts and into the guide groove through the guide body.

21. The doctor holder of claim 15, further comprising a guide cylinder located at the side of the guide body from which the doctor strip leaves the guide body, the guide cylinder guiding the doctor strip to be at least partially wrapped around the guide cylinder, the guide cylinder having a circumferential groove therearound placed for aligning with the cutouts in the doctor strip as it is being guided around the guide cylinder, the circumferential groove in the guide cylinder being shaped and positioned to receive the separate guide elements removed from the cutouts.

22. The doctor holder of claim 15, further comprising an attachment part attached to the guide body for receiving individual guide elements therein; the removing means comprising a mechanical reciprocating device including means for operating the ram to push guide elements out of the cutouts of the doctor strip in the region of the attachment part.

23. The doctor holder of claim 22, further comprising a guide cylinder having a surface with projections defined on it, the projections being placed and shaped for being received in the cutouts in the doctor strip, whereby as the guide cylinder rotates, the doctor strip is conducted over the guide cylinder;

a circular cam path with cams thereon and supported at the guide cylinder, operating means connected with the ram on the one hand and with the cams on the cam path on the other hand for coordinating operation of the ram with the rotation of the guide cylinder and with the movement of the doctor strip for enabling the ram to remove the individual guide elements from the cutouts in the doctor strip.

24. The doctor holder of claim 14, further comprising an additional guide path in the guide body for movement of the guide elements therealong, a gear wheel in the additional guide path which includes corresponding teeth and spaces, each space holding in it a respective guide element, the gear wheel being located at the side of the guide body where the guide strip exits the guide body, and the gear wheel being so placed as to enable the spacer cutouts in the gear wheel to receive guide elements from the cutouts of the doctor strip.

25. The doctor holder of claim 24, wherein the additional guide path begins at and extends away from the gear wheel for defining a return path for the guide elements carried by the gear wheel away from the doctor strip.

26. The doctor holder of claim 25, wherein the additional guide path is shaped for bringing the guide elements to the side of the guide path at which the doctor strip enters the guide path, for delivering guide elements to the installing means for supplying guide elements to the doctor strip cutouts.

* * * * *